United States Patent [19]

Dreibelbis et al.

[11] 4,009,806

[45] Mar. 1, 1977

[54] DISPENSING HEAD FOR FLUID DISPENSING SYSTEMS HAVING ELEMENTS MADE FROM PLASTIC MATERIAL

[75] Inventors: Richard C. Dreibelbis, Fair Lawn; Warren E. Turner, Succasunna, both of N.J.

[73] Assignee: Emerson Electric Co. (H & H Thermostats Div.), Cedar Grove, N.J.

[22] Filed: June 18, 1975

[21] Appl. No.: 588,049

Related U.S. Application Data

[63] Continuation-in-part of Ser. No. 536,177, Dec. 24, 1974, abandoned.

[52] U.S. Cl. ..... 222/545; 222/559; 239/29.5

[51] Int. Cl.[2] ..... B65D 47/00

[58] Field of Search ..... 222/544, 567, 189, 559, 222/545, 469; 137/240; 239/29.5, 242

[56] References Cited

UNITED STATES PATENTS

| | | | |
|---|---|---|---|
| 2,081,131 | 5/1937 | Barnes | 222/567 X |
| 2,888,028 | 5/1959 | Hill | 137/240 |
| 3,285,296 | 11/1966 | Ishimaru et al. | 222/189 X |
| 3,554,446 | 1/1971 | Castillo | 239/29.5 X |
| 3,567,121 | 2/1969 | Dreibelbis | 239/29.5 |
| 3,625,437 | 12/1971 | Garrigou | 239/469 |
| 3,854,665 | 12/1974 | Rodgers | 239/242 |

*Primary Examiner*—Stanley H. Tollberg
*Assistant Examiner*—Hadd Lane
*Attorney, Agent, or Firm*—Daniel H. Bobis

[57] ABSTRACT

A dispensing head for use in a fluid dispensing system has a base member made from an inert plastic material with locking guide means at the lower section thereof and boss means at the upper section. The boss means has a shoulder a predetermined distance from the locking guide means and a control valve cavity which extends into the base member from the upper surface of the boss means so as to communicate with an inlet for fluid to be dispensed and an outlet for dispensing said fluid respectively disposed in the base member a spaced distance therefrom. A guard member also made of an inert plastic material has a connecting section and a shield section. The connecting section forms a shaped cavity with locking guide grooves on the inner wall of the connecting section so that the guard member in assembled position will operatively engage locking guide means at the lower end and a shoulder at the upper end of the base member. The connecting section of the guard member has an opening thereon and in assembled position the opening is aligned with the control valve cavity to permit means to be connected in the control valve cavity for locking the base member and guard member in assembled position in a fluid dispensing system. Said means including, a thin walled metal insert ultrasonically welded in the control valve cavity, a retaining ring mounted on said metal insert and sized to extend through the aligned opening when the guard member is in assembled position, and a cover member threadibly connected on the extended portion of the retaining ring.

A nozzle is removably fitted in the outlet means in the base member, a means is provided in the outlet means to hold the nozzle in assembled position.

7 Claims, 18 Drawing Figures

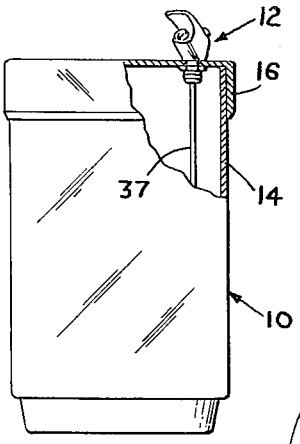
FIG. 1
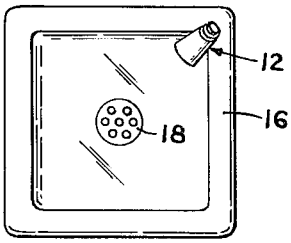
FIG. 2
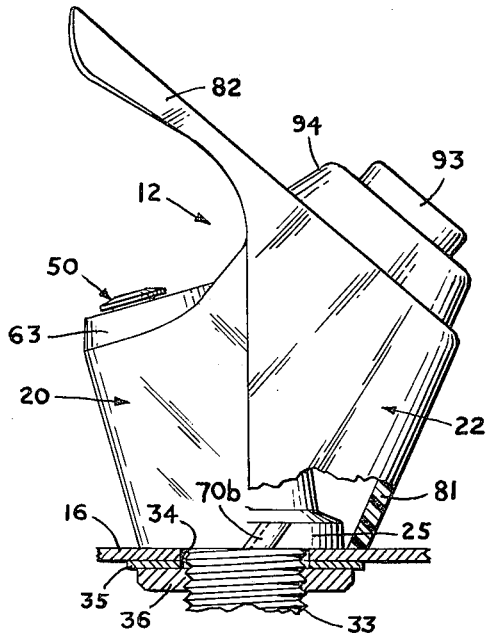
FIG. 3
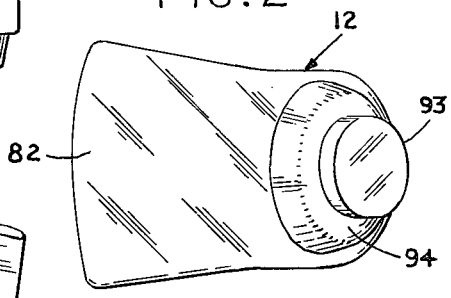
FIG. 5
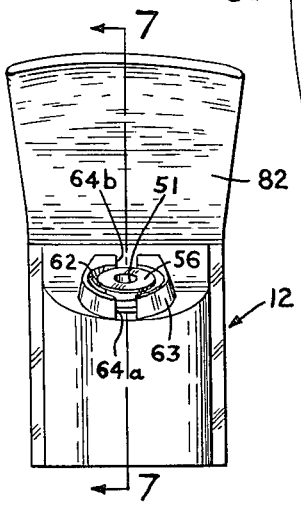
FIG. 4
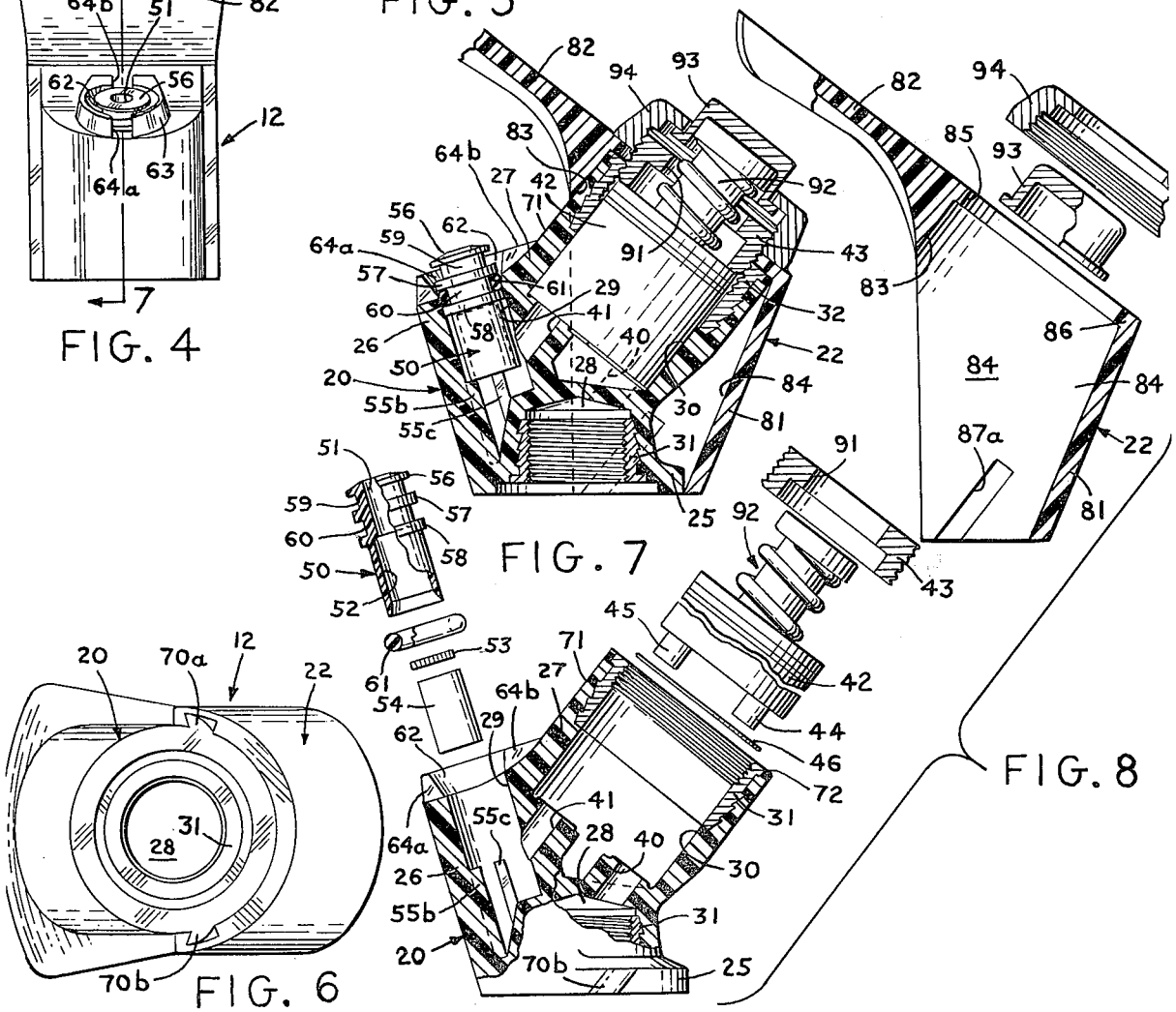
FIG. 7
FIG. 8
FIG. 6

DISPENSING HEAD FOR FLUID DISPENSING SYSTEMS HAVING ELEMENTS MADE FROM PLASTIC MATERIAL

This application is a continuation-in-part of application Ser. No. 536,177 filed Dec. 24, 1974, now abandoned.

BACKGROUND OF THE INVENTION

This invention relates generally to fluid dispensing systems and more particularly, to a dispensing head for use in such systems which includes elements made from an inert plastic material.

Dispensing heads for fluid dispensing systems such as drinking fountains, water coolers, and the like, are known in the prior art as shown in U.S. Pat. Nos. 3,039,697; 3,003,519; 3,493,010 and 3,033,466. Such dispensing heads are generally manufactured from easily machined non-ferrous metals, such as brass for long life, freedom from corrosion and are given an attractive appearance by being plated with chromium as is understood by those skilled in the art.

In U.S. Pat. No. 3,567,121 a variation of this arrangement is provided for a combination manual therewith, foot operated dispensing member, assembly for food dispensing systems, which includes an inner body and support member for the control valve, an outlet for the fluid dispensing system and a split outer casing disposed about and coacting with the inner body and support member to customize the dispensing head assembly.

Such prior art devices are costly as to raw material and require considerable labor to achieve the necessary accuracy of closely fitted parts and the unblemished surfaces required for the desired attractive appearance and ease of cleaning.

The present invention provides an improved dispensing head in which the principal structural parts are made from suitable plastic materials, preferably molded to accurate shapes for rigid assembly and attractive appearance without the many intermediate finishing steps required by the prior art devices. Further, the plastic materials from which dispensing heads in accordance with the present invention are made are readily available having the strength, hardness, wear resistance and molding characteristics desired and may be chromium-plated without prior polishing.

Further, the plastic elements of the dispensing heads in accordance with the present invention are shaped for mutually rigid support and protection, and are secured in assembled position by means which reduce the likelihood of tampering or removal by persons who are not aware of the internal construction of such dispensing heads.

Locking as used herein is intended to identify the fastening interrelation of the respective locking parts on the plastic elements of the dispensing head which fixedly connect the plastic elements together in assembled position and the means to prevent such tampering and removal of the dispensing head in assembled position in a forward dispensing system.

The elements of the dispensing heads in accordance with the present invention made from plastic materials may be used in the natural color of the plastic or may be given a chromium-plated finish if desired. In either case the cost of manufacture is much less and the use of this type material is easier than machining the parts from the non-ferrous metals in accordance with the prior art devices, coupled with the necessary polishing and plating steps to obtain the desired appearance and finish as above outlined.

SUMMARY OF THE INVENTION

Thus, the present invention covers a dispensing head for a fluid dispensing system having an irregularly shaped base member made from an inert plastic material with locking guide means at the lower section, boss means at the upper section of the base member has a shoulder with at least one straight side disposed a predetermined distance from the locking guide means, and a control valve cavity extending into the base member from the uppermost surface of the boss means. The control valve cavity communicates with inlet means connected to the fluid dispensing system and outlet means on the base member spaced from the boss means so that when the control valve means is mounted in the control valve cavity the flow of fluid being dispensed through the outlet means can be controlled. A guard member also made from an inert plastic material has a connecting section and a shield section. The connecting section is disposed in assembled position to fit about the base member so that the shield section continuous with the connecting section will be disposed over the outlet means in the base member. The connecting section on the guard member defines a shaped cavity and has locking guide grooves on the inner wall thereof. In assembled position the locking guide grooves so engage the locking guide means on the base member that the shaped cavity will abut the shoulder as formed on the boss and thus substantially position the connecting section of the guard member relative the base member. The guard member has an opening thereon and in this assembled position the opening is aligned with the control valve cavity, to permit means to be connected to the wall of the control valve cavity for holding the base member and guard member in assembled position.

The means to hold the base member and guard member in assembled position includes, a thin walled metal insert ultrasonically welded in the control valve cavity, a retaining ring mounted on the metal insert sized to extend through the aligned opening when the guard member is in assembled position, and a cover member threadibly connected on the extended portion of the retaining ring.

A nozzle is disposed to removably fit into the outlet means in the base members, and means is provided in the outlet means to hold the nozzle in assembled position.

Thus, it is an object of the present invention to provide an improved dispensing head for fluid dispensing system such as a drinking fountain or water cooler.

It is another object of the present invention to provide a dispensing head which can be manufactured at lower cost by making the elements of the dispensing head from suitable plastic materials.

It is a still further object of the present invention to provide a dispensing head which can be made in a choice of finishes, such as colored plastic or a polished metal plating.

DESCRIPTION OF THE FIGURES

These and other objects of the invention will be clear to those skilled in the art from the following description when considered in connection with the annexed drawings, in which:

FIG. 1 is a front elevation of a water-cooler with one form of dispensing head in accordance with the present invention, having the water cooler housing partly broken away to show the inlet fluid piping connection to the dispensing head.

FIG. 2 is a top view of the water-cooler and dispensing head shown in FIG. 1.

FIG. 3 is a side view of the form of dispensing head in accordance with the present invention shown in FIG. 1 with a portion of the guard member broken away to show the locking guide means on the base member.

FIG. 4 is a front view of the dispensing head shown in FIG. 3.

FIG. 5 is a top view of the dispensing head shown in FIG. 3.

FIG. 6 is a bottom view of the dispensing head shown in FIG. 3 showing the inlet opening, and the locking guide means on the base number and the associate locking guide grooves on the guard member.

FIG. 7 is a vertical section taken on the line 7—7 of FIG. 4.

FIG. 8 is an exploded view of the nozzle member, guard member, cartridge assembly, retaining nut, push-button and cover of the dispensing head partly in section.

Referring to the drawings, FIGS. 1 and 2 show a drinking fountain or water cooler 10, having a dispensing head generally designated 12 in accordance with the present invention. Drinking fountains or water coolers of the type shown are readily available on the open market.

Figure 10:
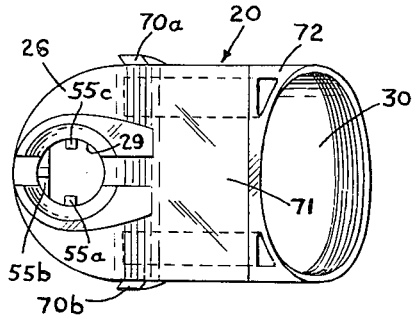
FIG. 10 is a view of the base member along the axis of the outlet bore.

The water cooler 10 has a protective outer housing 14 and the dispensing head 12 is disposed on the top member 16 of the housing 14 at a location convenient for the user drinking from the stream of water dispensed from the dispensing head 12 when the dispensing head is actuated.

To collect any waste or unused portion of the water dispensed, the top number 16 of the drinking fountain 10 is contoured to slope downward to a drain 18, which is connected to a waste pipe, not shown, for disposal. The dispensing head 12 will be located and oriented on the top member so that the water dispensed will fall within the collecting area of the top member 16.

The dispensing head 12 represents one form of the present invention and is shown in FIGS. 3 to 7 as including, a base member 20 and a guard member 22.

The base member 20 and guard member 22 and other elements of the dispensing head 12 as hereinafter described are formed, preferably by molding, from any suitable inert plastic material, such as acrylonitrile-butadiene-styrene (ABS). The outer surfaces of these plastic parts may be left in the dark natural color of the plastic or may be coated with a chrome plated finish if desired.

The base member 20 is an irregularly shaped element having a lower section 25 and upper section 26 and a boss 27 which projects at an angle to the lower section 25 and upper section 26. Extending upwardly from the bottom surface of the lower section 25 is an inlet chamber or inlet cavity 28 extending angularly downward from the top surface of the upper section 26 is an outlet bore or cavity 29 and extending inwardly and angularly downward is a control valve cavity 30.

Although the plastic walls of the base member 20 which form the inlet cavity 28 and the control valve cavity 30 could be threaded or molded with threads therein it is believed well understood by those skilled in the art that such threads cannot stand the normal wear and tear of use nor can the pressures that are applied to metal parts be applied to such plastic threads.

Accordingly the inlet cavity 28 and the control valve cavity 30 are provided with relatively light thin walled cylindrical metal inserts as at 31 and 32 which are press fitted into the respective cavities 28 and 30 and then ultrasonically welded to provide a permanent liquid tight seal between the metal of the insert and the plastic wall of the base member 20 which forms the respective inlet cavity or chamber 28 and the control valve cavity 30 all of which is clearly shown in FIGS. 7 and 8 of the drawings.

Cylindrical metal inserts for this purpose are easily purchaseable on the open market and therefore will not be more fully described herein.

In order to fasten the dispensing head 12 to the top member 16 of the water cooler an externally threaded nipple 33 sufficiently long is connected into the threaded insert 31 in the inlet cavity 28 so that a portion thereof projects below the lower section 25 of the base member 20 as shown in FIG. 3 of the drawings. This extended portion of the threaded nipple 33 can be fitted into a hole 34 in the top member 16 of the drinking fountain 10 so that a washer 35 and nut 36 can be mounted and threaded respectively on the nipple 33 and tightened to hold the dispensing head 12 in assembled position on the drinking fountain 10.

The nipple member 33 also provides means for connecting the inlet water or fluid line 37 which delivers the cooled water to be dispensed to the dispensing head 12.

It is thought clear that by reason of the position of the nipple 33 being threadibly mounted in the metal insert 31 that cooled fluid or water to be dispensed will pass into the inlet cavity 28.

The inlet cavity 28 communicates through inlet passage 40 with the control valve cavity 30 and the control valve cavity in turn communicates through an outlet passage 41 with the outlet bore 29. In order to control the flow of cooled fluid or water to be dispensed from the inlet cavity 28 to the outlet bore 29, a control valve assembly or cartridge type control valve generally designated 42 is mounted in the control valve cavity 30 by means of an externally threaded ring or retaining nut 43 which as shown in FIGS. 7 and 8 is sufficiently long not only to hold the control valve cartridge 42 in assembled position but further will extend beyond the upper face of the boss 27 for reasons that will be clear in respect of the description which follows below in regard to the assembly of the guard member 22 onto the base member 20.

The control valve cartridge 42 as shown in FIGS. 7 and 8 has two downwardly projecting members as at 44 and 45 which fit into the respective inlet passage 40 and outlet passage 41 in assembled position. A suitable gasket as at 46 will be provided to form liquid tight seals between the control valve cartridge 42 and the respective inlet passage 40 and outlet passage 42 all of which is clearly shown in FIGS. 7 and 8 of the drawings.

Control valve cartridges of the type shown as well as the control valve cavity for receiving the same are well known in the art and hence are not more fully described herein.

However when so assembled the control valve cartridge will act to control the flow of cooled fluid or water from the inlet cavity 28 to the outlet bore 29 and the operation of such control valve cartridges for this purpose is also well known and will be understood by those skilled in the art.

When the cooled fluid or water reaches the outlet bore 29 it will be dispensed through a discharge nozzle or spout generally designated 50 which is removably mounted in the outlet bore 29.

Discharge nozzle or spout 50 is an elongated cylindrical member which is also made from any suitable type of inert plastic such as ABS. In the longitudinal line of spout 50 a discharge passage 51 is provided which opens to the exterior of the spout 50 at one end to provide the point where fluid or water will be dispensed from the dispensing head 12. At the opposite end discharge passage 51 communicates with a filter cavity 52 in which a filter screen 53 and a combined filter and fluid straightener 54 are mounted. Filter cavity 52 opens at the end of spout 50 remote from the dispensing end of the dispensing passage 51. This permits fluid delivered to the outlet bore or outlet cavity 29 to pass freely through the combined filter and fluid straightener 54 and fluid screen 53 to the discharge passage 51 where it will then be dispensed through the dispensing opening formed by the end of the discharge passage 51 all of which is shown in FIGS. 7 and 8 of the drawings.

FIGS. 7 and 8 further show that filter screen 53 and combined filter and fluid straightener 54 are held in assembled position by inwardly projecting shoulders or stops 55A, 55B, and 55C which are formed near the bottom portion of the outlet bore or outlet cavity 29. The shoulders or stops 55A, 55B and 55C are shown more clearly in FIG. 10 of the drawings as circumferentially spaced members disposed at approximately 90° from each other and extending radially inward to a point at least sufficient to engage and limit inward movement of the spout 50 when it is mounted in the outlet bore or outlet cavity 29 as is hereinafter described and to hold the combined filter and fluid straightener element 54 in position in the end of the spout 50.

Discharge nozzle or spout 50 will also be molded or otherwise formed with a plurality of circumferential flanges as at 56, 57 and 58. Circumferential flange 56 is disposed about the dispensing end of the dispensing nozzle or spout 50 and the circumferential flanges 57 and 58 are spaced inwardly therefrom and from each other to provide circumferential grooves 59 and 60 there between as is shown in FIGS. 7 and 8 of the drawings.

FIGS. 7 and 8 show that the outer diameter of the circumferential flanges 57 and 58 will be such that the spout can be press fitted into the outlet bore 29 and more specifically the diameter will be such that it will form a friction fit with the wall of the outlet bore 29 to hold the spout 50 in assembled position against the normal pressures which prevail in the fluid being dispensed from the fluid dispensing system with which the dispensing head 12 is associated and as was indicated above when spout 50 is press fitted into the outlet bore 29 inward movement thereof is limited by the shoulders or stops 55A, 55B and 55C.

In order to prevent the escape of fluid being dispensed past the circumferential flange 58 when the spout 50 is in assembled position in the outlet bore 29 an O ring 61 is provided in the circumferential groove 60 which as shown in FIG. 7 will engage the wall of the outwardly diverging end 62 of the outlet bore 29 to provide the desired fluid tight seal for the dispensing nozzle or spout 50.

FIGS. 4, 7, 8, 10 and 12 show that the outwardly diverging end 62 of the outlet bore 29 is formed by a boss 63 which lies about the dispensing nozzle or spout 50 when it is in assembled position. This boss serves to protect and guard the end of the spout 50 from damage and further includes spaced slots as at **64*a* and 64*b* which will permit the insertion of suitable tools to engage the circumferential groove 59 for removing the spout 50 from the outlet bore 29** when the same must be removed for replacement or repair.

In order to enable the guard member 22 to operatively and properly engage the base member 20 the base member is provided on the lowest section with locking guide means consisting of at least two spaced lugs or keying members as at **70*a* and 70*b* and at the upper end of the boss 27 thereon with a shoulder 72** which is generally D-shaped in plain view.

Figure 9:
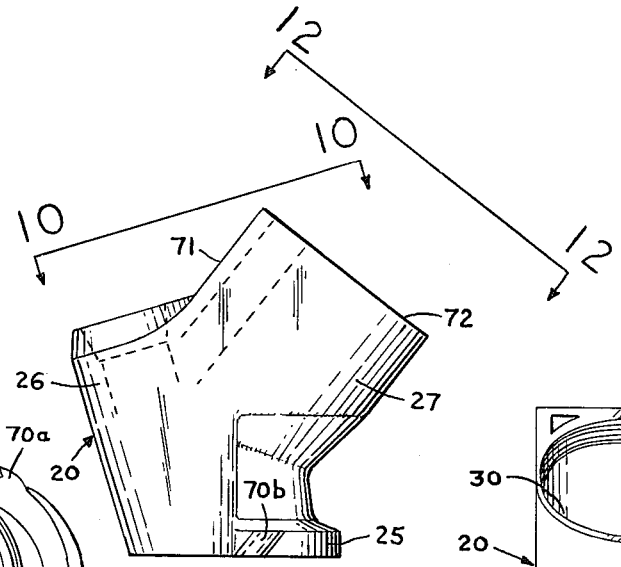
FIG. 9 is a side elevation of the base member.
Figure 11:
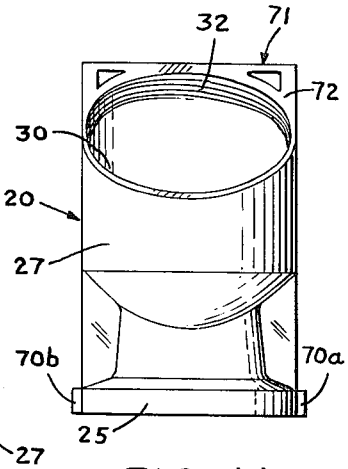
FIG. 11 is a rear view of the base member.
Figure 12:
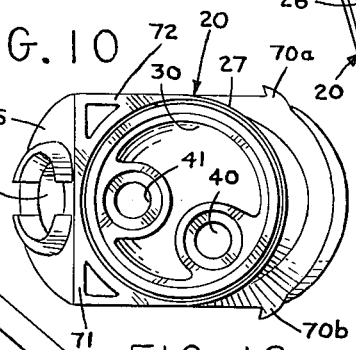
FIG. 12 is a view of the base member along the axis of the control valve cavity.
Figure 13:
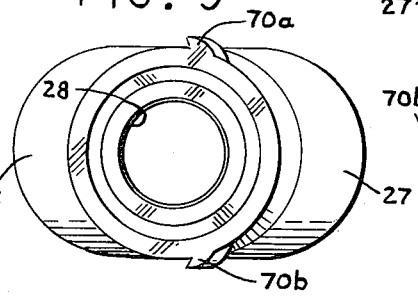
FIG. 13 is a bottom view of the base member.
Figure 14:
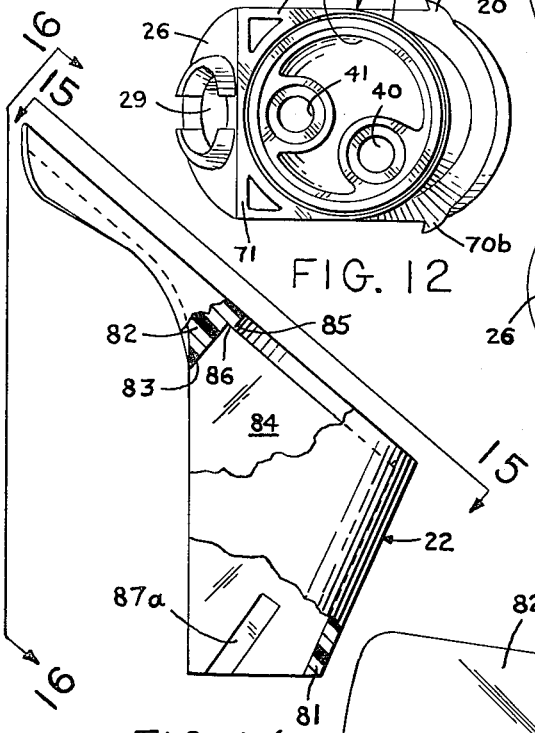
FIG. 14 is a side elevational view of the guard member partly in vertical section and with a portion of the connecting section broken away to show the locking guide grooves that mate with the locking guide means on the base members.
Figure 15:
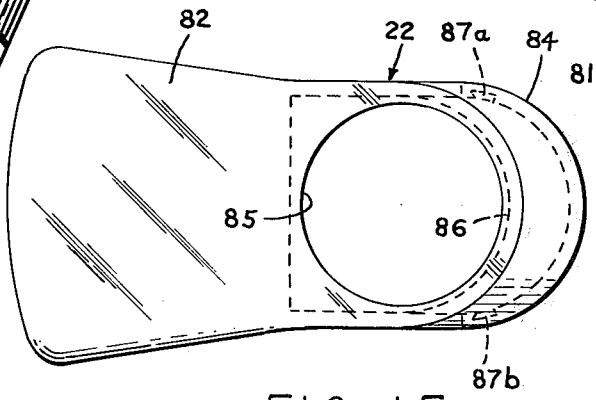
FIG. 15 is a top view of the guard member, along line 15—15 of FIG. 14.
Figure 16:
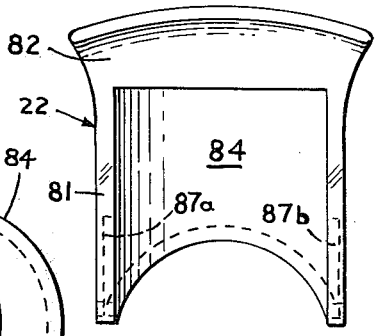
FIG. 16 is a front view of the guard member along line 16—16 of FIG. 14.
Figure 17:
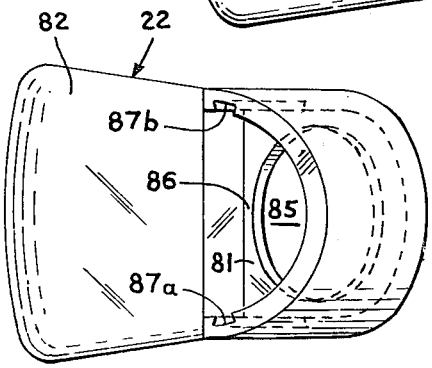
FIG. 17 is a bottom view of the guard member showing the locking guide grooves in the wall of the connecting section of the guard member which mates with the locking guide means on the base member.

FIGS. 6, 9, 11, 12 and 13 show that the lowest section 25 of the base member 20 is substantially circular and that the lugs or keying members **70*a* and 70*b* of the locking guide means are disposed on opposite sides of the medial line thereof at approximately 180° from each other. Further the lugs or keying members 70*a* and 70*b* are disposed at the same angle to the vertical plane through the dispensing head 12 as the boss 27, as is shown in FIGS. 7, 8 and 9 of the drawings. This angular arrangement of the lugs or keying means 70*a* amd 70*b* of the locking guide means and the boss 27 facilitates the positioning and locking of the guard member 22 when it is assembled onto the base member 20. FIGS. 10, 11 and 12 show that the shoulder formed by the upper end of the boss 27 is D-shaped in plain view because of the flat planar surface 71 that is formed on the side of the boss 27 which faces the outlet bore 29 in the upper section 26 of the base member 20. This shoulder is a fixed distance from the bottom of the lower section 25 and the locking guide means 70*a* and 70*b* for reasons that will appear clear from the description of the guard member 22 and the manner in which the guard member is locked into assembled position on the base member 20** as will now be described.

THE GUARD MEMBER

The guard member 22 is an irregularly shaped element which includes a connecting section 81 and a shield section 82 continuous therewith. The connecting section 81 of the guard member 22 is semi circular in shape and with the flat planar surface 83 at the butt end of the shield section 82 of the guard member 22 forms a elongated cavity 84 having a D-shape at the upper end thereof. The elongated cavity 84 is open at the bottom end because in assembled position the guard member 22 will fit about the lower section 25 of the base member 20. At the upper D-shaped end the cavity 84 communicates with an access opening as at 85 which also provides an inwardly extending flange as at 86 all of which is shown in FIGS. 7, 8, 14, 15 and 17 of the drawings.

FIGS. 6, 14, 15, 16 and 17 further show that on the inner wall of the lower portion of the connecting section 81 which forms the cavity 84 there are locking guide grooves or slots as at 87*a* and 87*b*. The locking guide grooves or slots 87*a* and 87*b* extend upwardly from the bottom edge of the connecting section 81 and as will be clear from FIGS. 6, 8, 14, 15, 16 and 17 will be at the same angle as the lugs or keying means 70*a* and 70*b* of the locking guide means into which the guide means or slots 87*a* and 87*b* will engage to lock the guard member 22 in assembled position.

The upper D-shaped section of the cavity 84 and the flange 86 are so shaped and spaced from the locking guide grooves or slots 87*a* and 87*b* that when the guard member 22 is assembled to the base member 20 the D-shaped section and flange 86 will engage the shoulder 72 and the flat planar face 71 on the boss 27 of the base member 20. When so assembled the shield section 82 which is connected to and continuous with the connecting section 81 will extend and lie over the discharge nozzle or spout 50 to protect the user of the dispensing head from stray streams or sprays of water or other fluid.

The guard member 22 can either be preassembled to the base member of the dispensing head or assembled on the base member 20 after the base member 20 is affixed to its point of use in the fluid dispensing system as is shown for example in FIGS. 1 to 3 of the drawings and above described.

The guard member 22 fits into correct mutual relationship on the base member 20 because the locking guide grooves or slots 87*a* and 87*b* engage the lugs or keys 70*a* and 70*b* of the locking guide means at the proper angle and the D-shaped section at the upper end of the shaped cavity 84 fit snugly about the boss 27 and the flat planar wall 71 thereon. Guard member 22 and base member therefore can be brought into snug relationship until the inwardly extending flange 86 formed about the access opening 85 abuts the shoulder 72 on the boss 27.

The predetermined distance the shoulder 72 will be spaced from the lugs or keying members 70*a* and 70*b* will be a function of the vertical length or distance between the bottom of the connecting member and the underside or inner wall of the shaped cavity at the flange 86.

The locking guide grooves or slots will be longer then the lugs or keys 70*a* and 70*b* to permit the flange 86 to seat against the shoulder 72 when the guard member and base member are brought into assembled relationship.

Because of the angularity and spaced positions of the lugs or keys 70*a* and 70*b* and by reason of the D-shaped character of both the shoulder and upper section of the shaped cavity 84 the guard member and base member will have no horizontal movement and no relative rotation therebetween.

The guard member 22 and base member 20 are prevented from moving in a vertical direction once assembled by suitable means which coacts with the retaining nut 43 which holds the control valve cartridge in assembled position.

Thus retaining nut 43 is made sufficiently long so that after it is tightened against the control valve cartridge 42 it will project not only beyond the upper surface of the shoulder 72 on the boss 27 but further will extend through and beyond the opening 85 on the guard member 22 disposed in alignment with the cartridge cavity 29 in the base member.

The retaining nut 43 in accordance with known prior art practices will have a bore 91 therethrough and this will permit the actuating means generally designated 92 for the control valve cartridge to project therethrough for engagement by a pushbutton 93 by means of which the actuating means for the control valve cartridge 42 is placed into operation.

The guard member 22 is secured in position against vertical movement relative the base member 20 by a cover member 94 which fits about the pushbutton 93 and is threadably mounted on the threaded portion of the retaining nut 43 which extends through the opening 85 in the guard member 22.

Since the pushbutton 93 projects through the cover member 94 actuation of the control valve cartridge assembly 42 can be accomplished by depressing the pushbutton in the conventional manner as will be clearly understood by those skilled in the art.

When the pushbutton 93 is depressed the control valve cartridge assembly 42 will be opened to permit cooled fluid to pass from the inlet chamber 28 through the control valve to the outlet bore or outlet cavity 29 and thence through the discharge nozzle 50 to the point of use. When the pushbutton is released the control valve will move to close position and since this operation is well known and fully described in the prior art the control valve assembly and its operation will not be more fully described herein.

The cover member 94 and pushbutton 93 may also be formed from suitable inert plastic materials such as ABS and are preferably made by molding or other simple forming techniques. As in the case of other elements of the dispensing head above described the cover member and pushbutton may be left in the dark natural color of the plastic or may be given a chrome plated or other finish as may be desired.

Figure 18:
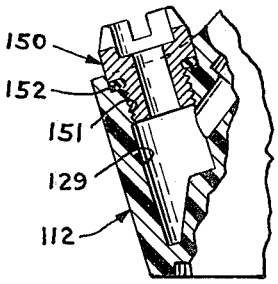
FIG. 18 is a fragmentary view of the base member showing another form of nozzle means.

FIG. 18 shows only a fragment of another form of dispensing head 112 which differs from the dispensing head 12 shown in FIGS. 1 to 17 of the drawings in that the dispensing nozzle or spout 150 is threadibly mounted in the outlet bore 129. Outlet bore 129 will therefore be modified to receive the dispensing nozzle or spout 150 by providing a threaded section as at 151 at the point where the outlet bore 129 opens to the exterior of the dispensing head 112. This could of course also be done by the use of a thin walled metal insert (not shown) which would be ultrasonically welded into the open end of the outlet bore in the same manner illustrated for the control valve cavity 30 in the form of the invention shown in FIGS. 1 to 17 of the drawings and above described.

The dispensing nozzle or spout 150 will be provided with an O-ring 152 to render the same fluid tight with respect to the outlet bore 129 when the dispensing nozzle 150 is in assembled position therein.

Thus there has been described above two forms of dispensing heads in which the major elemants thereof are molded or formed from plastic materials. This construction and the materials from which it is made simplifies and reduces the costs of manufacture of similar type devices now known in the prior art and provides additional conditions of durability and serviceability for the uses to which such devices are put.

It will be understood that the invention is not to be limited to the specific construction or arrangement of parts shown but that the device as above described may be widely modified within the scope of the invention as now defined by the appended claims.

What is claimed is:

1. A dispensing head for a fluid dispensing system comprising, a. a base member made from an inert plastic material having an inlet chamber in the lower section, an outlet chamber in the upper section, a control valve cavity spaced from said inlet chamber and said outlet chamber, and passage means for fluid in the base member connecting said inlet chamber to said control valve - cavity, and said control valve cavity to said outlet chamber, b. means for connecting said base member to said fluid dispensing system and to a source of fluid to be dispensed, c. locking guide means formed adjacent to the lower section of said base member, d. guard means made of an inert plastic material having a connecting section and a shield section continuous therewith e. said guard means having locking guide grooves disposed on said connecting section to engage the locking guide means on the base member.

f. stop means on the base member to maintain the guard member in predetermined assembled position, g. and means for holding said base member and said guard member in assembled position.

2. A dispensing head for use in a fluid dispensing system comprising, a. a base member made from an inert plastic material including, locking guide means at the lower section thereof, and outlet means at the upper section thereof, b. boss means on said base member disposed at an angle to the vertical line of said base member and forming a control valve cavity in said base member disposed for communication with said outlet means, c. said boss means forming shoulder means at the upper end thereof a predetermined distance from the locking guide means having at least one straight side thereon, d. a guard member made from an inert plastic material including, a connecting section and a shield section, e. said connecting section of the guard member having an inner wall forming a shaped cavity with at least one straight side thereon, and locking guide grooves on the inner wall of said shaped cavity whereby in assembled position said guide grooves will engage the locking guide means on the base member and the shaped cavity will mate with the shoulder means on the base member, f. said guard member having an opening therein in alignment with the control valve cavity in said base means in assembled position, and g. means to hold the guard member and the base member in assembled position.

3. In a dispensing head as claimed in claim 2 wherein the means to hold the guard member and the base member in assembled position includes, a. connecting means attached to the wall of the boss means forming the control valve cavity and disposed to extend through said opening in the guard member, and b. means connected to said connecting means disposed to engage and hold the guard member in assembled position on the base member.

4. In a dispensing head as claimed in claim 3 wherein the connecting means comprises; relatively thin walled threaded metal inserts ultrasonically welded into assembled position, to the wall of the boss means forming the control valve cavity.

5. In a dispensing head as claimed in claim 2 including, a. stop members disposed on the inner wall of the outlet means formed in said base member, b. a nozzle member made of an inert plastic material and having a predetermined length, and c. said nozzle member sized to fit in said outlet means and disposed for engagement with the stop means in assembled position.

6. In a dispensing head as claimed in claim 2 wherein, a. said locking guide means includes, spaced lugs, b. said spaced lugs disposed on opposite sides of the base member and at the same angle to the vertical line of the base member as said boss means, and c. said guide locking grooves on the guard member disposed at the same angle as the spaced lugs.

7. In a dispensing head as claimed in claim 2 wherein the base member and the guard member are made from plastic material selected from the group: ACRYLONITRILE - BUTADIENE - STYRENE (ABS); POLYBUTYLENE TEREPHTHALATE and ACETAL COPOLYMERS.

* * * * *